US006338385B1

(12) United States Patent
Muchow

(10) Patent No.: US 6,338,385 B1
(45) Date of Patent: Jan. 15, 2002

(54) RETRIEVABLE DOWNHOLE ADJUSTABLE CHOKE

(75) Inventor: John Daniel Muchow, Sugar Land, TX (US)

(73) Assignee: Hydril Company, Houston, TX (US)

( * ) Notice: Subject to any disclaimer, the term of this patent is extended or adjusted under 35 U.S.C. 154(b) by 0 days.

(21) Appl. No.: 09/548,807

(22) Filed: Apr. 14, 2000

Related U.S. Application Data

(60) Provisional application No. 60/129,572, filed on Apr. 16, 1999.

(51) Int. Cl.[7] ..... E21B 34/14

(52) U.S. Cl. ..... 166/194; 166/185; 166/334.4; 166/242.5; 251/121

(58) Field of Search ..... 166/91.1, 142, 166/185, 192, 194, 242.5, 334.1, 334.4, 386, 188; 251/120–122; 138/44–46

(56) References Cited

U.S. PATENT DOCUMENTS 3,887,008 A * 6/1975 Canfield ..... 166/267
4,047,695 A 9/1977 Cleveland et al. ..... 251/122
4,337,788 A 7/1982 Seger ..... 137/315
5,443,124 A * 8/1995 Wood et al. ..... 166/374
5,535,767 A * 7/1996 Schnatzmeyer et al. ..... 137/1

OTHER PUBLICATIONS

Hydril Brochure, "BFB Flow Cone and Seat Nozzle" and "PRB Plug and Nozzle", 1 page, undated.

* cited by examiner

*Primary Examiner*—David Bagnell
*Assistant Examiner*—Zakiya Walker
(74) *Attorney, Agent, or Firm*—Rosenthal & Osha L.L.P.

(57) ABSTRACT

A downhole adjustable choke includes a choke body which is adapted to be lowered into a borehole. The choke body has a bore and an orifice connected to the bore. A sleeve is disposed inside the bore of the choke body. The sleeve has an orifice which is aligned with the orifice in the choke body. An actuator is coupled to move a flow plug inside the sleeve so that the flow area of the orifice in the sleeve is adjustable.

49 Claims, 2 Drawing Sheets

RETRIEVABLE DOWNHOLE ADJUSTABLE CHOKE

CROSS REFERENCE TO RELATED APPLICATIONS

This application claims benefit of provisional application serial No. 60/129,572, filed on Apr. 16, 1999.

BACKGROUND OF THE INVENTION

1. Technical Field

The invention relates generally to devices for regulating flow in oil and gas wells. More specifically, the invention relates to a downhole adjustable choke which is suited for metering of well fluid.

2. Background Art

In a multi-zone production well, it is often desirable to produce well fluid over a range of flow rates from different production zones. This flow control may be achieved through a downhole adjustable choke in each production zone. Typically, the downhole adjustable choke includes an orifice with a flow area that can be suitably adjusted to achieve different flow rates. This orifice is typically provided by a tapered plug which extends into a tapered valve seat. The flow area of the orifice is increased or decreased by moving the tapered plug relative to the tapered valve seat. When the tapered plug tightly engages the tapered valve seat, flow through the orifice is prevented. The downhole adjustable choke, however, operates in the presence of highly corrosive fluids and solid particles which can erode the tapered plug and/or valve seat such that the tapered plug can no longer tightly engage the tapered valve seat or the condition of the flow through the orifice is undesirably altered. In such a situation, the tapered plug and/or valve seat will need to be replaced to allow the adjustable choke to function properly. This valve-seat replacement operation is generally time consuming and expensive and may need to be repeated frequently to ensure that flow is properly controlled.

SUMMARY OF THE INVENTION

The invention is a downhole adjustable choke which comprises a choke body that is adapted to be lowered into a borehole. The choke body has a bore and an orifice connected to the bore. A sleeve is disposed inside the bore of the choke body. The sleeve has an orifice which is aligned with the orifice in the choke body. A flow plug is movably disposed inside the sleeve. An actuator coupled to the flow plug moves the flow plug relative to the sleeve so that the flow area of the orifice in the sleeve is adjustable.

DETAILED DESCRIPTION

Figure 1:
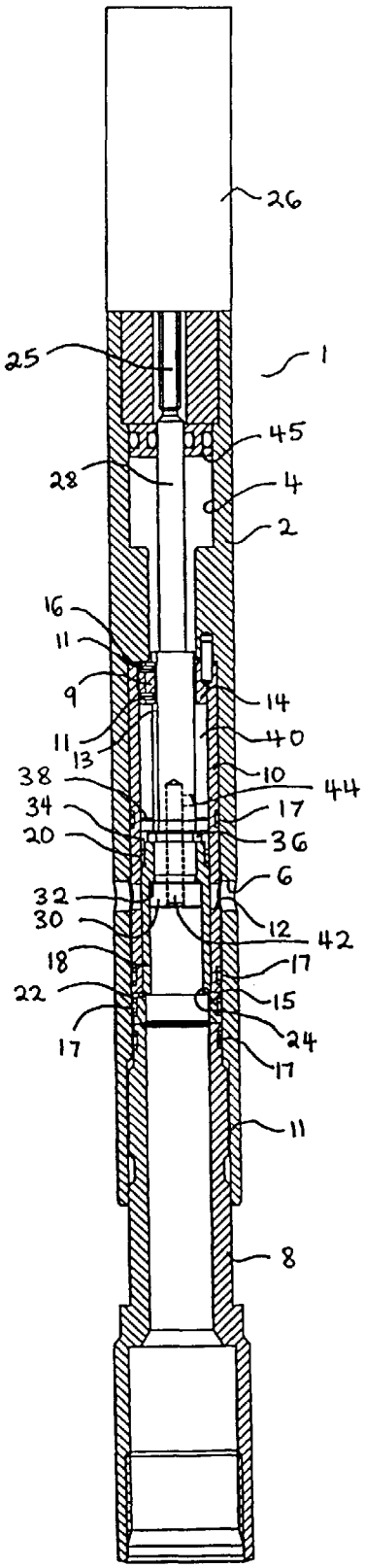
FIG. 1 is a cross section view of a downhole adjustable choke.

FIG. 1 depicts a downhole choke 1 which comprises a choke body 2. The choke body 2 is provided with a bore 4 and one or more orifices 6 which are in communication with the bore 4. An outlet nipple or sub 8 is received in the lower end of the choke body 2. The outlet nipple 8 is secured to the lower end of the choke body 2 by a threaded connection 11. A sleeve 10 is disposed in the bore 4. The wall of the sleeve

10 includes one ore more orifices 12. The upper end of the sleeve 10 is secured to an indexing ring 14, which is disposed in the bore 4, by a tongue and groove connection (not shown). The indexing ring 14 is attached to a shoulder 16 in the choke body 2. When the sleeve 10 engages the indexing ring 14 as shown, the orifices 12 in the wall of the sleeve 10 are aligned with the orifices 6 in the choke body 2, thus allowing fluid to flow inside the sleeve 10. A valve seat 15 is arranged between the sleeve 10 and the outlet nipple 8. The lower end of the valve seat 15 abuts the outlet nipple 8 so that the valve seat 15 is retained within the bore 4 by the outlet nipple 8. Seals 17 are provided to seal between the choke body 2 and the sleeve 10, between the choke body 2 and the outlet nipple 8, and between the choke body 2 and the valve seat 15. The seals 17 prevents fluid leakage from between the choke body 2 and the outlet nipple 8.

A flow plug 18 is disposed inside the sleeve 10 to control the rate at which fluid flows through the orifices 12. The flow plug 18 is movable within the sleeve 10 to increase or decrease the flow area of the orifices 12 or to close the orifices 12. A seal 20 is provided between the flow plug 18 and the sleeve 10. The seal 20 prevents fluid leakage from between the flow plug 18 and the sleeve 10. The flow plug 18 has a profile 22 which is adapted to mate with a similar profile 24 in the valve seat 15 so as to allow the valve seat 15 to provide a positive stop for the flow plug 18. When the profiles 22 and 24 contact, the flow plug 18 is in the closed position, i.e., there in no flow through the orifices 12. An actuator 26 is mounted at the upper end of the choke body 2. The actuator 26 is coupled to the flow plug 18 by a plunger 28. As shown, the plunger 28 extends from the actuator 26 into the flow plug 18. The free end 30 of the plunger 28 abuts a shoulder 32 in the flow plug 18 such that when the actuator 26 moves the plunger 28 relative to the sleeve 10, the flow plug 18 also moves.

The plunger 28 is provided with an anti-rotation feature which prevents it from rotating when the output shaft 25 of the actuator 26 rotates. This anti-rotation feature includes a key 9, which is attached to the indexing ring 14 with pins 11, and a key way 13 in the plunger 28. The key 9 engages the key way 13 in the plunger 28, thereby preventing the plunger 28 from rotating. A cup 34 is secured to the plunger 28 by a split ring 36 and pins 38. The cup 34 prevents the plunger 28 from falling through the flow plug 18. A chamber 40 is defined between the sleeve 10, the plunger 28, the flow plug 18, and the seat indexing ring 14. Pressure in the interior of the flow plug 18 is communicated to the chamber 40 through a flow channel 42 and a flow port 44 in the plunger 28, so that the pressure in the chamber 40 is equalized with the pressure below the plunger 28. By equalizing the pressure in the chamber 40 with the pressure below the plunger 28, the actuator 26 acts against minimal differential force. A packing seal set 45 seals between the choke body 2 and the plunger 28.

Figure 2:
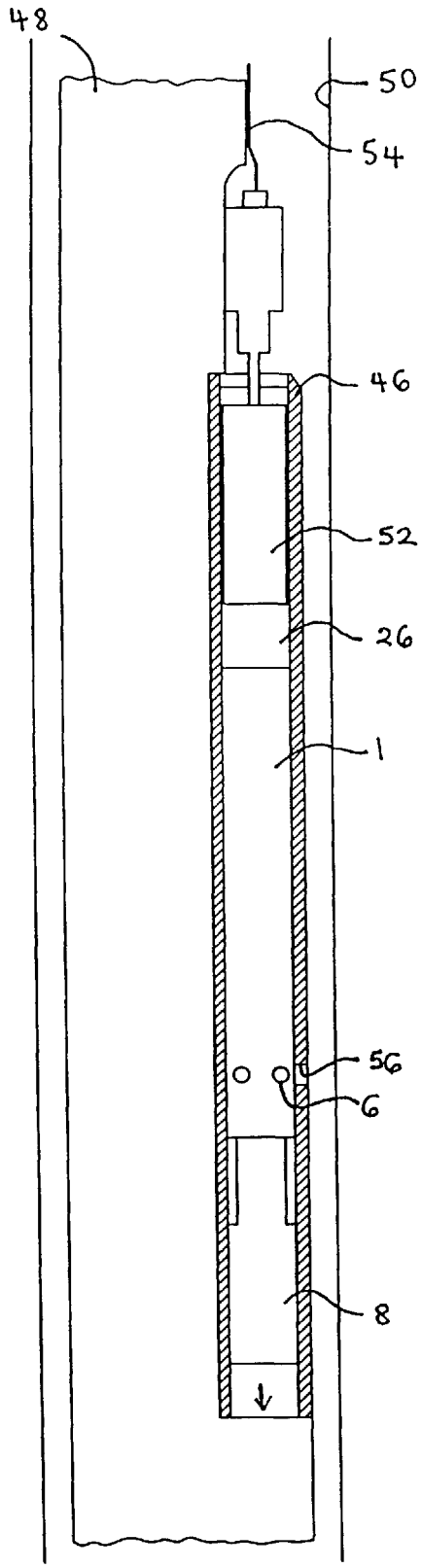
FIG. 2 shows the downhole adjustable choke of FIG. 1 in a retrievable side pocket mandrel of a production tubing.

FIG. 2 shows the downhole choke 1 in a retrievable side pocket mandrel 46 of a production tubing 48 that is suspended in a borehole 50. The downhole choke 1 may be run into the side pocket mandrel 46 on the end of a wireline or coiled tubing. A control module 52 at the upper section of the mandrel 46 communicates with the actuator 26. The control module 52 includes the electronic circuitry required to control the operation of the actuator 26. Power and commands may be transmitted to the control module 52 and the actuator 26 through a power/communications cable 54 that runs from the surface. Alternatively, the downhole choke 1 may be run into the side pocket mandrel 46 on a composite coiled tubing that includes integrated power/data conductors. The pocket mandrel 46 includes flow ports 56 through which fluid in the borehole 50 can flow into the orifices 6 in the choke body 2. The outlet nipple 8 is hydraulically connected to the interior of the tubing 48.

In operation, commands are sent to the control module 52, and the control module 52 in turn controls the actuator 26 to move the flow plug 18. The commands may be sent to the control module 52 through the cable 54 as previously described or by modulating a column of fluid in the borehole 50. Alternatively, commands may also be sent to the actuator 26 directly from the surface through integrated power/data conductors in a composite coiled tubing. Fluid flows into the sleeve 10 through the orifices 12 when the actuator 26 lifts the flow plug 18 from the valve seat 15. The amount of fluid flowing through the orifices 12 is controlled by how much of the flow area of the orifices 12 is exposed. In an alternate embodiment, rows of orifices can be provided in the choke body 2 and the sleeve 10, and the flow plug 18 can selectively open the orifices on a row so that fluid can flow into the sleeve 10 at a selected rate. The fluid which flows into the sleeve 10 exits the choke body 2 through the outlet nipple 8 and flows into the tubing 48.

While the invention has been described with respect to a limited number of embodiments, those skilled in the art will appreciate that other embodiments can be devised which do not depart from the scope of the invention as disclosed herein. Accordingly, the scope of the invention should be limited only by the attached claims.

What is claimed is:

1. A downhole adjustable choke, comprising:

a choke body adapted to be lowered into a borehole, the choke body having a bore and an orifice connected to the bore, the choke body adapted to be lowered into a retrievable side pocket mandrel coupled to a tubing in the borehole;

a sleeve disposed inside the bore, the sleeve having an orifice aligned with the orifice in the choke body;

a flow plug movably disposed inside the sleeve; and an actuator coupled to move the flow plug relative to the sleeve so that the flow area of the orifice in the sleeve is adjustable.

2. The downhole adjustable choke as defined in claim 1 further comprising a seal between the sleeve and the choke body.

3. The downhole adjustable choke as defined in claim 1 further comprising means for aligning the orifice in the sleeve with the orifice in the choke body.

4. The downhole adjustable choke as defined in claim 3 wherein the means for aligning comprises an indexing ring secured to an inner wall of the choke body and adapted to be engaged with the sleeve.

5. The downhole adjustable choke as defined in claim 1 further comprising a valve seat disposed inside the bore, the valve seat providing a positive stop for the flow plug.

6. The downhole adjustable choke as defined in claim 5 wherein flow through the orifice in the sleeve is prevented when the flow plug abuts the valve seat.

7. The downhole adjustable choke as defined in claim 1 wherein the actuator is coupled to the flow plug by a plunger.

8. The downhole adjustable choke as defined in claim 7 further comprising an indexing ring secured to an inner wall of the choke body, the indexing ring engaging the sleeve so that the orifice in the sleeve is aligned with the orifice in the choke body.

9. The downhole adjustable choke as defined in claim 8 wherein the indexing ring and the plunger comprise mutually cooperating structures adapted to prevent rotation of the plunger when the actuator is operated.

10. The downhole adjustable choke as defined in claim 7 wherein the plunger extends from the actuator into the sleeve, a chamber being defined between the sleeve and the plunger.

11. The downhole adjustable choke as defined in claim 10, further comprising a flow channel and port in the plunger adapted to communicate a pressure in the interior of the flow plug to the chamber.

12. The downhole adjustable choke as defined in claim 11 further comprising a seal adapted to seal between the choke body and the plunger.

13. The downhole adjustable choke as defined in claim 1 wherein the choke body is adapted to be lowered into the borehole on an end of a coiled tubing.

14. The downhole adjustable choke as defined in claim 1 wherein the choke body is adapted to be lowered into the borehole on an end of a wireline.

15. The downhole adjustable choke as defined in claim 1 wherein the choke body is adapted to be lowered into the borehole on an end of a coiled tubing, the coiled tubing having integral power and data conductors therein.

16. The downhole adjustable choke as defined in claim 1 further comprising multiple aligned orifices in the choke body and the sleeve.

17. The downhole choke as defined in claim 1 further comprising means for retaining the valve seat in the bore of the choke body.

18. A downhole adjustable choke, comprising:

a choke body adapted to be lowered into a borehole, the choke body having a bore and an orifice connected to the bore;

a sleeve disposed inside the bore, the sleeve having an orifice aligned with the orifice in the choke body;

a flow plug movably disposed inside the sleeve;

an actuator coupled to move the flow plug relative to the sleeve so that the flow area of the orifice in the sleeve is adjustable; and an indexing ring secured to an inner wall of the choke body adapted to engage the sleeve, the indexing ring adapted to align the orifice in the sleeve with the orifice in the choke body.

19. The downhole adjustable choke as defined in claim 18, wherein the choke body is adapted to be lowered into a retrievable side pocket mandrel coupled to a tubing in the borehole.

20. The downhole adjustable choke as defined in claim 18 further comprising a valve seat disposed inside the bore, the valve seat providing a positive stop for the flow plug.

21. The downhole adjustable choke as defined in claim 20 wherein flow through the orifice in the sleeve is prevented when the flow plug abuts the valve seat.

22. The downhole adjustable choke as defined in claim 18 wherein the actuator is coupled to the flow plug by a plunger.

23. The downhole adjustable choke as defined in claim 22 wherein the indexing ring and the plunger comprise mutually cooperating structures adapted to prevent rotation of the plunger when the actuator is operated.

24. The downhole adjustable choke as defined in claim 22 wherein the plunger extends from the actuator into the sleeve, a chamber being defined between the sleeve and the plunger.

25. The downhole adjustable choke as defined in claim 24, further comprising a flow channel and port in the plunger adapted to communicate a pressure in the interior of the flow plug to the chamber.

26. The downhole adjustable choke as defined in claim 25 further comprising a seal adapted to seal between the choke body and the plunger.

27. The downhole adjustable choke as defined in claim 18 further comprising a seal between the sleeve and the choke body.

28. The downhole adjustable choke as defined in claim 18 wherein the choke body is adapted to be lowered into the borehole on an end of a coiled tubing.

29. The downhole adjustable choke as defined in claim 18 wherein the choke body is adapted to be lowered into the borehole on an end of a wireline.

30. The downhole adjustable choke as defined in claim 18 wherein the choke body is adapted to be lowered into the borehole on an end of a coiled tubing, the coiled tubing having integral power and data conductors therein.

31. The downhole adjustable choke as defined in claim 18 further comprising multiple aligned orifices in the choke body and the sleeve.

32. The downhole choke as defined in claim 18 further comprising means for retaining the valve seat in the bore of the choke body.

33. A downhole adjustable choke, comprising:

a choke body adapted to be lowered into a borehole, the choke body having a bore and an orifice connected to the bore;

a sleeve disposed inside the bore, the sleeve having an orifice aligned with the orifice in the choke body;

a flow plug movably disposed inside the sleeve; and an actuator coupled to move the flow plug relative to the sleeve so that the flow area of the orifice in the sleeve is adjustable, the actuator coupled to the flow plug by a plunger.

34. The downhole adjustable choke as defined in claim 33 further comprising means for aligning the orifice in the sleeve with the orifice in the choke body.

35. The downhole adjustable choke as defined in claim 34 wherein the means for aligning comprises an indexing ring secured to an inner wall of the choke body and adapted to be engaged with the sleeve.

36. The downhole adjustable choke as defined in claim 33, wherein the choke body is adapted to be lowered into a retrievable side pocket mandrel coupled to a tubing in the borehole.

37. The downhole adjustable choke as defined in claim 33 further comprising a valve seat disposed inside the bore, the valve seat providing a positive stop for the flow plug.

38. The downhole adjustable choke as defined in claim 37 wherein flow through the orifice in the sleeve is prevented when the flow plug abuts the valve seat.

39. The downhole adjustable choke as defined in claim 33 further comprising an indexing ring secured to an inner wall of the choke body, the indexing ring engaging the sleeve so that the orifice in the sleeve is aligned with the orifice in the choke body.

40. The downhole adjustable choke as defined in claim 39 wherein the indexing ring and the plunger comprise mutually cooperating structures adapted to prevent rotation of the plunger when the actuator is operated.

41. The downhole adjustable choke as defined in claim 40 wherein the plunger extends from the actuator into the sleeve, a chamber being defined between the sleeve and the plunger.

42. The downhole adjustable choke as defined in claim 41, further comprising a flow channel and port in the plunger adapted to communicate a pressure in the interior of the flow plug to the chamber.

43. The downhole adjustable choke as defined in claim 33 further comprising a seal adapted to seal between the choke body and the plunger.

44. The downhole adjustable choke as defined in claim 33 wherein the choke body is adapted to be lowered into the borehole on an end of a coiled tubing.

45. The downhole adjustable choke as defined in claim 33 wherein the choke body is adapted to be lowered into the borehole on an end of a wireline.

46. The downhole adjustable choke as defined in claim 33 wherein the choke body is adapted to be lowered into the borehole on an end of a coiled tubing, the coiled tubing having integral power and data conductors therein.

47. The downhole adjustable choke as defined in claim 33 further comprising multiple aligned orifices in the choke body and the sleeve.

48. The downhole choke as defined in claim 33 further comprising means for retaining the valve seat in the bore of the choke body.

49. The downhole adjustable choke as defined in claim 33 further comprising a seal between the sleeve and the choke body.

* * * * *